US012503771B2

(12) United States Patent
Komatsuzaki et al.

(10) Patent No.: US 12,503,771 B2
(45) Date of Patent: Dec. 23, 2025

(54) RUST-PROOFING TREATMENT METHOD, AND RUST-PROOFING-TREATED ARTICLE

(71) Applicant: NOF METAL COATINGS ASIA PACIFIC CO., LTD., Kanagawa (JP)

(72) Inventors: Takumi Komatsuzaki, Kanagawa (JP); Satoru Tamaki, Kanagawa (JP)

(73) Assignee: NOF Metal Coatings Asia Pacific Co., Ltd., Kanagawa (JP)

( * ) Notice: Subject to any disclaimer, the term of this patent is extended or adjusted under 35 U.S.C. 154(b) by 497 days.

(21) Appl. No.: 17/763,072

(22) PCT Filed: Sep. 23, 2020

(86) PCT No.: PCT/JP2020/035851
§ 371 (c)(1),
(2) Date: Mar. 23, 2022

(87) PCT Pub. No.: WO2021/060294
PCT Pub. Date: Apr. 1, 2021

(65) Prior Publication Data

US 2022/0372626 A1 Nov. 24, 2022

(30) Foreign Application Priority Data

Sep. 26, 2019 (JP) ..... 2019-174904

(51) Int. Cl.
*C23C 22/48* (2006.01)
*C23C 22/07* (2006.01)
*C23C 22/82* (2006.01)

(52) U.S. Cl.
CPC ..... *C23C 22/48* (2013.01); *C23C 22/07* (2013.01); *C23C 22/82* (2013.01)

(58) Field of Classification Search
CPC ..... C23C 22/48; C23C 22/07; C23C 22/82; C23C 18/127; C23C 22/60; C23C 22/66;
(Continued)

(56) References Cited

U.S. PATENT DOCUMENTS 4,231,812 A * 11/1980 Paulus ..... C23C 22/73 148/261
9,970,113 B2 5/2018 Özcan et al.
(Continued)

FOREIGN PATENT DOCUMENTS

CN 101326308 A * 12/2008 ..... C09D 5/086
DE 1191200 B 4/1965
(Continued)

OTHER PUBLICATIONS

CN-101326308-A Translation (Year: 2008).*
(Continued)

*Primary Examiner* — Danielle M. Carda

(57) ABSTRACT

The present invention relates to: a rust-proofing treatment method comprising the step of treating an object that comprises a metal or an alloy and is heated to a temperature higher than 180° C. or an object that has, formed on the surface thereof, a film or layer comprising a metal or an alloy and is heated to a temperature higher than 180° C. with an aqueous solution containing an inorganic acid or an inorganic salt, or comprising the step of treating an object comprising a metal or an alloy or an object having, formed on the surface thereof, a film or layer comprising a metal or an alloy with an aqueous solution containing at least one component selected from silicic acid, a silicic acid salt, phosphoric acid, a phosphoric acid salt, a monohydrogen phosphate salt, a dihydrogen phosphate salt and a zirconium salt; and an article characterized by being rust-proofing-treated by the rust-proofing treatment method.

9 Claims, 2 Drawing Sheets

(58) Field of Classification Search
CPC ..... C23C 22/73; C23C 22/74; C23C 18/1216; C23C 22/42; C23C 22/68; C23C 22/77; C23C 22/78; B05D 1/18; B05D 3/02; B05D 7/14; B05D 2202/00; B05D 2202/10; B05D 2202/25; B05D 2258/00; B05D 2401/20; B05D 2601/28; B05D 3/0218; B05D 3/0254; C09D 5/103; C09D 5/106
USPC ..... 148/261
See application file for complete search history.

(56) References Cited

U.S. PATENT DOCUMENTS

| | | | | |
|---|---|---|---|---|
| 2006/0166014 | A1* | 7/2006 | Klotz | C04B 41/009 427/372.2 |
| 2012/0024428 | A1 | 2/2012 | Ohtani et al. | |
| 2012/0288700 | A1* | 11/2012 | McMullin | C09D 5/082 977/773 |
| 2015/0284854 | A1* | 10/2015 | Özcan | C23C 22/73 427/427 |
| 2019/0144688 | A1* | 5/2019 | Kang | C09D 163/00 106/14.12 |

FOREIGN PATENT DOCUMENTS

| | | | | |
|---|---|---|---|---|
| EP | 1506982 | B1 | 10/2006 | |
| EP | 2088223 | A1 | 8/2009 | |
| JP | 54148142 | A | 11/1979 | |
| JP | 2006263625 | A * | 10/2006 | C23C 22/66 |
| JP | 2012505963 | A | 3/2012 | |
| JP | 2013022508 | A | 2/2013 | |
| JP | 2013510932 | A | 3/2013 | |
| JP | 2014211198 | A | 11/2014 | |
| JP | 2018070999 | A | 5/2018 | |
| KR | 10-2011-0124365 | | 11/2011 | |
| WO | 2013042239 | A1 | 3/2013 | |

OTHER PUBLICATIONS

JP2006263625A Translation (Year: 2006).*
Chinese Application No. 202080067508.7; Chinese Office Action dated Jun. 14, 2024; 16 pages.
Extended European Search Report for EP Application No. 20868611.3-1103/4001459 PCT/JP2020/035851; dated—Sep. 19, 2023; 14 pages.
International Search Report; International Application No. PCT/JP2020/035851; International Filing Date—Sep. 23, 2020; Date of Mailing—Nov. 17, 2020; 2 pages.
CN Office Action and Translation—Notice of Review Opinion for Patent Application No. 109133407, Date of Publication—Mar. 5, 2024, 1-3.
TW Office Action and Translation—Notice of Review Opinion for Patent Application No. 109133407, Date of Publication—Mar. 5, 2024, 1-3.
Partial Supplementary European Search Report mailed Jun. 27, 2023, issued by the European Patent Office for European Application No. 20868611.3, 10 pages.
JP Office Action Issued for Application No. 2021-548942 dated Aug. 7, 2024; 5 pages.

* cited by examiner

[FIG. 1A]
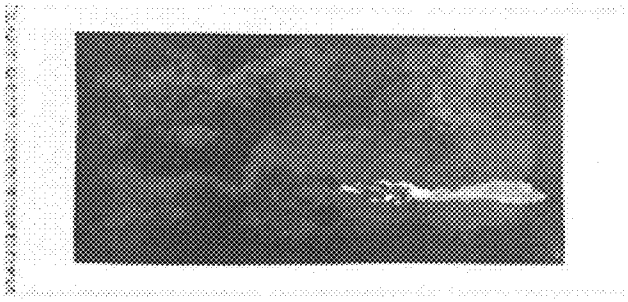
[FIG. 1B]
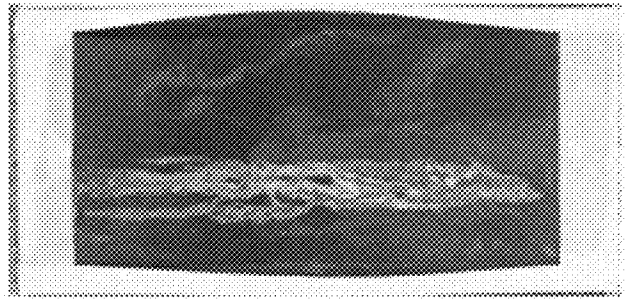

[FIG. 2A]
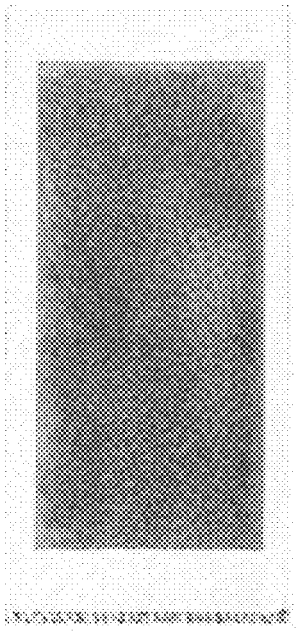
[FIG. 2B]
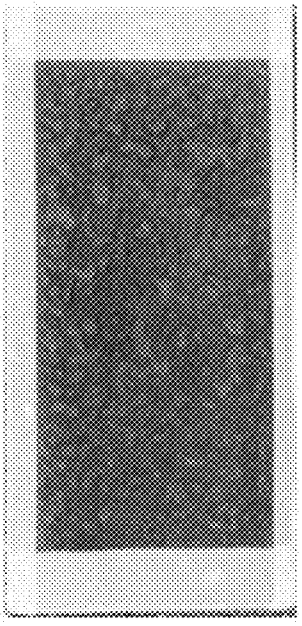

RUST-PROOFING TREATMENT METHOD, AND RUST-PROOFING-TREATED ARTICLE

CROSS REFERENCE TO RELATED APPLICATIONS

This application is a National Stage application of PCT/JP2020/035851, filed Sep. 23, 2020, which claims priority to JP Application No. 2019-174904, filed Sep. 26, 2019, the entire contents of which are incorporated herein by reference.

TECHNICAL FIELD

The present disclosure relates to a rustproofing method and a rustproofed article.

BACKGROUND ART

In conventional rustproofing methods, an antirust film or an antirust layer that contains a metal or an alloy such as zinc is generally formed on a surface of metals or alloys.

For example, Patent Document 1 discloses an anticorrosive coating composition, containing metal particles having an inorganically based modification (specifically, silicon dioxide) on their surface (specifically, metal particles formed on the basis of zinc or zinc alloys), and a corrosion protection coating available from the anticorrosive coating composition.

Patent Document 2 discloses a cured coating composition for corrosion inhibition or corrosion prevention for metallic substrates, the composition including a resin binder and nanoparticles (specifically, ZnO, $Al_2O_3$, Al(O)OH or the like) of which surface is treated with at least one surface modifying group (specifically, polydialkylsiloxane or the like).

Patent Document 3 discloses a method for producing deformable corrosion protection layers on a metal surface, the method including: a step of mixing metallic magnesium, zinc, aluminum or titanium particles, or mixtures or alloys containing at least one of these metals with at least one metal compound, in which a reaction between the metal particles and metal compound(s) results in surface-modified metal particles; a step of applying the resulting surface-modified metal particles to the metallic surface; a step of hardening the layer produced from the surface-modified metal particles at temperatures between room temperature and 500° C.; and a step of tempering performed at temperatures ranging from 250° C. to approx. 700° C. and lasting for a few seconds to some hours.

PRIOR ART DOCUMENT

Patent Document

[Patent Document 1] Japanese Unexamined Patent Application Publication No. 2018-70999

[Patent Document 2] Japanese Patent Application Laid-Open No. 2013-510932

[Patent Document 3] Japanese Patent Application Laid-Open No. 2012-505963

SUMMARY OF THE INVENTION

Problems to be Solved by the Invention

However, higher rust proof performance is desirable, and it is also desirable to be able to easily impart good rust proof performance.

The present disclosure provides a rustproofing method capable of easily imparting better rust proof performance to metal materials or alloy materials. It also provides an article having better rust proof performance.

Means for Solving the Problems

The present disclosure relates to the following items.

[Item 1] A rustproofing method, including: a step of treating an object to be treated, which contains a metal or an alloy or has on a surface a film or a layer containing a metal or an alloy, and has been heated to a temperature above 180° C., with an aqueous solution containing an inorganic acid or an inorganic salt.

[Item 2] The rustproofing method according to Item 1, in which the object to be treated has a temperature above 220° C. when treated with the aqueous solution.

[Item 3] The rustproofing method according to Item 1 or 2, in which the aqueous solution containing an inorganic acid or an inorganic salt is an aqueous solution containing at least one selected from silicic acid, silicate, phosphoric acid, phosphate, monohydrogen phosphate, dihydrogen phosphate, sulfuric acid, sulfate, nitric acid, nitrate, molybdenum acid, molybdate, and zirconium salt.

[Item 4] The rustproofing method according to any one of Items 1 to 3, in which the aqueous solution contains 0.1% by mass or more of an inorganic acid and/or an inorganic salt.

[Item 5] The rustproofing method according to any one of Items 1 to 4, in which the aqueous solution containing an inorganic acid or an inorganic salt further contains a lubricant.

[Item 6] The rustproofing method according to any one of Items 1 to 5, in which the aqueous solution containing an inorganic acid or an inorganic salt has a pH of 4 or more.

[Item 7] The rustproofing method according to any one of Items 1 to 6, not including: a step of heating the object to be treated to a temperature of 200° C. or more after treating the object to be treated with the aqueous solution.

[Item 8] A rustproofing method, including: a step of treating an object to be treated, which contains a metal or an alloy or has on a surface a film or a layer containing a metal or an alloy, with an aqueous solution containing at least one selected from silicic acid, silicate, phosphoric acid, phosphate, monohydrogen phosphate, dihydrogen phosphate, and zirconium salt.

[Item 9] The rustproofing method according to Item 8, in which the aqueous solution containing an inorganic acid or an inorganic salt further contains a lubricant.

[Item 10] The rustproofing method according to Item 8 or 9, not including: a step of heating the object to be treated to a temperature of 200° C. or more after treating the object to be treated with the aqueous solution.

[Item 11] The rustproofing method according to any one of Items 1 to 10, in which the object to be treated contains at least one selected from zinc, zinc alloys, aluminum, aluminum alloys, iron, and iron alloys, or has on a surface a film or a layer containing at least one selected from zinc, zinc alloys, aluminum, aluminum alloys, iron, and iron alloys.

[Item 12] The rustproofing method according to any one of Items 1 to 10, in which the object to be treated has on a surface an antirust film containing at least one selected from zinc, zinc alloys, aluminum, and aluminum alloys.

[Item 13] An article that is rustproofed by the rustproofing method according to any one of Items 1 to 12.

Effects of the Invention

The present disclosure provides a rustproofing method capable of easily imparting better rust proof performance to metal materials or alloy materials. In addition, the present disclosure provides an article having better rust proof performance.

BRIEF DESCRIPTION OF THE DRAWINGS

FIG. 1A is a photograph of a cold rolled steel sheet that was subjected to an immersion treatment with an aqueous solution of sodium silicate of Example 58 after one hour from the start of a salt spray test.

FIG. 1B is a photograph of the cold rolled steel sheet that was subjected to the immersion treatment with the aqueous solution of sodium silicate of Example 58 after five hours from the start of the salt spray test.

FIG. 2A is a photograph of a cold rolled steel sheet that was not subjected to an immersion treatment with an aqueous solution of sodium silicate of Comparative Example 14 after one hour from the start of a salt spray test.

FIG. 2B is a photograph of the cold rolled steel sheet that was not subjected to an immersion treatment with the aqueous solution of sodium silicate of Comparative Example 14 after five hours from the start of the salt spray test.

MODES FOR CARRYING OUT THE INVENTION

A rustproofing method of a first embodiment of the disclosure includes a step of treating an object to be treated, which contains a metal or an alloy or has on a surface a film or a layer containing a metal or an alloy, and has been heated to a temperature above 180° C., with an aqueous solution containing an inorganic acid or an inorganic salt (hereinafter, also referred to as "inorganic acid-based treatment agent"). A rustproofing method of a second embodiment of the disclosure includes a step of treating an object to be treated, which contains a metal or an alloy or has on a surface a film or a layer containing a metal or an alloy, with an aqueous solution containing at least one selected from silicic acid, silicate, phosphoric acid, phosphate, monohydrogen phosphate, dihydrogen phosphate, and zirconium salt. Hereinafter, the rustproofing method of the first embodiment of the present disclosure and the rustproofing method of the second embodiment of the present disclosure will also be collectively referred to as "the rustproofing method of the present disclosure".

According to the rustproofing method of the disclosure, an object to be treated, which contains a metal or an alloy or has on a surface a film or a layer containing a metal or an alloy, is treated with an inorganic acid-based treatment agent. Here, by setting the object to be treated at a temperature above 180° C., more preferably at a temperature above 220° C. when it is treated with the inorganic acid-based treatment agent, the rust proof performance of the object to be treated can be improved. Among inorganic acid-based treatment agents, when the object to be treated is treated with an aqueous solution containing at least one selected from silicic acid, silicate, phosphoric acid, phosphate, monohydrogen phosphate, dihydrogen phosphate, and zirconium salt, the rust proof performance of the object to be treated can be sufficiently improved even if the object to be treated has a temperature of 180° C. or less.

In other words, according to the rustproofing method of the first embodiment, in which an object to be treated is heated to a temperature above 180° C. and treated with the inorganic acid-based treatment agent, it is possible to easily impart better rust proof performance to metal materials or alloy materials. In addition, according to the rustproofing method of the second embodiment of the present disclosure, in which an object to be treated is treated with an aqueous solution containing at least one selected from silicic acid, silicate, phosphoric acid, phosphate, monohydrogen phosphate, dihydrogen phosphate, and zirconium salt, it is possible to easily impart better rust proof performance to metal materials or alloy materials in either case where the object to be treated is heated to a temperature above 180° C., or is not heated to a temperature above 180° C. and is, e.g., at a room temperature.

The inorganic acid-based treatment agent used in the present disclosure is an aqueous solution containing an inorganic acid and/or an inorganic salt. Examples of the inorganic acid and the inorganic salt include silicic acid, silicate, phosphoric acid, phosphate, monohydrogen phosphate, dihydrogen phosphate, sulfuric acid, sulfate, nitric acid, nitrate, molybdenum acid, molybdate, and zirconium salt. Here, as silicic acid and silicate, any of orthosilicic acid and orthosilicate, pyrosilicic acid and pyrosilicate, metasilicic acid and metasilicate or the like may be used. As phosphoric acid and phosphate, any of orthophosphoric acid and orthophosphate, pyrophosphoric acid and pyrophosphate, metaphosphoric acid and metaphosphate or the like may be used.

As the inorganic acid and the inorganic salt, silicic acid, silicate, phosphoric acid, phosphate, monohydrogen phosphate, dihydrogen phosphate, and zirconium salt are preferred among others. Silicate, phosphate, monohydrogen phosphate, dihydrogen phosphate, sulfate, nitrate, and molybdate as the inorganic salt are preferably metal salts, specifically monovalent metal salts such as lithium salt, sodium salt or potassium salt, or divalent metal salts such as magnesium salt or calcium salt. As zirconium salt, for example, ammonium zirconium carbonate, potassium zirconium carbonate, and sodium zirconium carbonate are preferred. As the inorganic acid and the inorganic salt, one kind of substance may be used alone or two or more substances may be used in combination.

The concentration of the inorganic acid-based treatment agent (an aqueous solution containing an inorganic acid or an inorganic salt), that is, the amount of the inorganic acid and/or the inorganic salt in the aqueous solution, is not particularly limited, but is usually preferably 0.1% by mass or more, more preferably 0.5% by mass or more, and still more preferably 1% by mass or more. In addition, the upper limit value of the concentration of the inorganic acid-based treatment agent, that is, the upper limit value of the amount of the inorganic acid and/or the inorganic salt in the aqueous solution is not particularly limited and the aqueous solution may be a saturated solution. However, it is usually preferably 15% by mass or less, more preferably 5% by mass or less.

The inorganic acid-based treatment agent may contain, within a range not impairing the desired effect thereof, an additive or an additive component such as a pH adjuster, a water-soluble crosslinker, a water-soluble resin, a lubricant, a pigment, a defoamer, a dispersant, an anti-settling agent, a leveling agent, a thickner, a delusterants, an antifoulant, an antiseptic agent, a UV absorber, a dye or the like. There are cases in which it is preferable to add an additive or an additive component such as a lubricant to the inorganic acid-based treatment agent for the purpose of improving or changing the physical properties of an article to be subjected to a rustproofing treatment. On the other hand, when it is not necessary to improve or change the physical properties of an article to be subjected to a rustproofing treatment, it is usually preferable that the inorganic acid-based treatment agent does not contain an additive component except for a pH adjuster. In addition, it is usually preferable that the inorganic acid-based treatment agent does not contain a solvent other than water, that is, it does not contain an organic solvent. However, in some cases, it is preferable to add an organic solvent in a small amount (e.g., 10% by mass or less, preferably 5% by mass or less) from the viewpoint of the dispersibility or the like.

According to an embodiment, the inorganic acid-based treatment agent used in the present disclosure preferably contains a lubricant. By adding a lubricant to the inorganic acid-based treatment agent, it is possible to reduce the friction coefficient of a surface of an article having been subjected to a rustproofing treatment of the present disclosure, and it is possible to easily control the friction coefficient of a surface of an article having been subjected to a rustproofing treatment of the present disclosure.

The lubricant is not particularly limited. Examples thereof include polyolefins and modified polyolefins (polyethylene, modified polyethylene, polypropylene, modified polypropylene, etc.), waxes such as paraffin, carnava waxes, fluororesins, melamine cyanurate, and hexagonal boron nitride. The waxes are usually preferably added and mixed in a form of an emulsion to prepare the inorganic acid-based treatment agent. Lubricants are commercially available. Examples of the lubricant that can be suitably used are CERAFLOUR 913 (product name), "CERAFLOUR 914" (product name), "CERAFLOUR 915" (product name), "CERAFLOUR 916" (product name), "CERAFLOUR 917" (product name), "CERAFLOUR 925" (product name), "CERAFLOUR 927" (product name), "CERAFLOUR 929" (product name), "CERAFLOUR 950" (product name), "CERAFLOUR 988" (product name), "CERAFLOUR 1000" (product name), "497" (product name), "AQUACER 507" (product name), "AQUACER 515" (product name), "AQUACER 526" (product name), "AQUACER 531" (product name), "AQUACER 537" (product name), "AQUACER 539" (product name), "AQUACER 552" (product name), "AQUACER 593" (product name), "AQUACER 840" (product name), "AQUACER 1547" (product name), "AQUAMAT 208" (product name), "AQUAMAT 263" (product name), "AQUAMAT 272" (product name), "AQUAMAT 8421" (product name), "HARDAMER PE02" (product name), "HARDAMER PE03" (product name), "HARDAMER PE04" (product name), "CERACOL 79" (product name), which are available from BYK Corporation; SANWAX 161-P (product name), SANWAX 131-P (product name), SANWAX 151-P (product name), SANWAX 171-P (product name), VISCOR 330-P (product name), VISCOR 440-P (product name), VISCOR 550-P (product name), VISCOR 660-P (product name), which are available from Sanyo Chemical Industries, Ltd.; "Hi-WAX 100P" (product name), "Hi-WAX 400P" (product name), "Hi-WAX 800P" (product name), "Hi-WAX 1105A" (product name), "Hi-WAX 2203A" (product name), "Hi-WAX 1120H" (product name), "Hi-WAX 4202E" (product name), "Hi-WAX 405MP" (product name), "Hi-WAX 4051E" (product name), "Hi-WAX 410P" (product name), which are available from Mitsui Chemicals, Inc.; LICOWAX PE 520 (product name), "LICOWAX PE 130" (product name), "LICOWAX PE 190" (product name), "LICOWAX PED 521" (product name), "LICOWAX PED 522" (product name), "LICOWAX PED 153" (product name), "LICOWAX PED 191" (product name), "LICOWAX PED 192" (product name), "LICOWAX 371 FP" (product name), "LICOCENE "PP 6102" (product name), "LICOCENE PP 6502" (product name), "LICOCENE PP 7502" (product name), "LICOCENE PP 1302" (product name), "LICOCENE PP 1502" (product name), "LICOCENE PP 1602" (product name), "LICOCENE PP 2602" (product name), "LICOCENE PP 3602" (product name), "LICOCENE PE 4201" (product name), "LICOCENE PE 5301" (product name), "LICOCENE PP MA 1332" (product name), "LICOCENE PP MA 6252" (product name), "LICOCENE PP MA 6452" (product name), "LICOCENE PP MA 7452" (product name), "LICOCENE PE MA 4221" (product name), "LICOCENE PE MA 4351" "CERIDUST 3620" (product name), "CERIDUST 3610" (product name), "CERIDUST 3715" (product name), "CERIDUST 6050 M" (product name), "CERIDUST 9610 F" (product name), "CERIDUST 9630 F" (product name), "CERIDUST 3920 F" (product name), "CERIDUST 3940 F" (product name), "CERIDUST 9202 F" (product name), "CERIDUST 9205 F" (product name), which are available from Clariant; "Epolene E-10" (product name), "Epolene E-10P" (product name), "Epolene E-14" (product name), "Epolene E-14E" (product name), "Epolene E-14EP" (product name), "Epolene E-14P" (product name), "Epolene E-16" (product name), "Epolene E-20" (product name), "Epolene E-20P" (product name), "Epolene EE-2" (product name), "Epolene E-43" (product name), "Epolene E-43P" (product name), which are available from Westlake; "Hi-Disper A-113" (product name), "Hi-Disper A-375" (product name), "Hi-Disper AB-50" (product name), "Hi-Disper AF-41" (product name), "Hi-Disper AQ-73" (product name), "Hi-Disper A-110" (product name), "Hi-Disper A-512" (product name), "Hi-Disper A-348" (product name), "Hi-Disper A-332" (product name), "Hi-Disper A-206N" (product name), "Hi-Disper AD-62" (product name), which are available from Gifu Shellac Manufacturing Co., Ltd.; "nanoFLONE PTFE AQ 60" (product name), "nanoFLONE PTFE AQ 50 SM" (product name), which are available from Shamrock Technologies, Inc.; "Poligen WE 1" (product name), "Poligen WE 3" (product name), "Poligen WE 4" (product name), "Poligen WE 6" (product name), "Poligen Wax V Flakes" (product name), which are available from BASF; and "LUBRON LDW-410" (product name), which are available from DAIKIN INDUSTRIES, LTD. As the lubricant, one kind of substance may be used alone, or two or more substances may be used in combination.

The amount of the lubricant in the inorganic acid-based treatment agent (an aqueous solution containing an inorganic acid or an inorganic salt) is not particularly limited and may be appropriately selected so as to obtain a desired friction coefficient of a surface of an article, but is usually preferably 10% by mass or less.

Incidentally, the inorganic acid-based treatment agent used in the present disclosure can be prepared by mixing and dissolving a predetermined amount of an inorganic acid and/or an inorganic salt as well as an additive or an additive component if necessary, in a water solvent by a known method.

According to an embodiment, the pH of the inorganic acid-based treatment agent (an aqueous solution containing an inorganic acid or an inorganic salt) used in the present disclosure is preferably 4 or more, more preferably 4 to 12. If the pH is less than 4, a surface containing a metal or an alloy may be susceptible to acid. On the other hand, as the pH increases, it may become necessary to take care in handling for safety reasons. Note that the pH in the present disclosure means a pH at 20° C.

In the present disclosure, since the pH of the inorganic acid-based treatment agent varies depending on the type and the concentration of the inorganic acid and the inorganic salt used, sodium hydroxide, potassium hydroxide, lithium hydroxide, nitric acid or the like may be used as a pH adjuster for the purpose of adjusting the pH to a predetermined value.

The object to be treated to which the rustproofing method of the present disclosure is applied has a metal material or an alloy material on a surface. Specifically, the object to be treated contains a metal or an alloy, or has on a surface a film or a layer containing a metal or an alloy. The film or the layer that contains a metal or an alloy may be formed on the whole surface of an object to be treated or may only be formed on a part of the surface.

Metal materials or alloy materials to which the rustproofing method of the present disclosure can be applied are not particularly limited. Examples thereof include zinc and zinc alloys such as Zn—Al alloys; aluminum and aluminum alloys such as Al—Mg alloys; iron and iron alloys such as carbon steel; and magnesium alloys such as Mg—Zn alloys.

Among them, when an object to be treated contains at least one selected from zinc, zinc alloys, aluminum, aluminum alloys, iron, and iron alloys, or has on a surface a film or a layer containing at least one selected from zinc, zinc alloys, aluminum, aluminum alloys, iron, and iron alloys, the rustproofing method of the present disclosure can be suitably applied to that object. Here, the zinc alloys (or the aluminum alloys) may be a zinc-aluminum alloy. As a rustproofing treatment of a metal material or an alloy material, an antirust film containing zinc, a zinc alloy, aluminum, or an aluminum alloy is generally formed on a surface thereof. Also in the case in which an object to be treated has on a surface such antirust film containing at least one selected from zinc, zinc alloys, aluminum, and aluminum alloys, the rustproofing method of the disclosure can be suitably applied to that object to be treated to further improve the rust proof performance.

According to the rustproofing method of the disclosure, an object to be treated, which contains a metal or an alloy or has on a surface a film or a layer containing a metal or an alloy, is preferably heated to a temperature above 180° C. or is not heated, and is treated with the above-described inorganic acid-based treatment agent (an aqueous solution containing an inorganic acid or an inorganic salt). The inorganic acid-based treatment agent may also be heated or may not be heated, or may be cooled to such an extent that it does not solidify. The treatment with the inorganic acid-based treatment agent may be performed, for example, by immersion treatment, in which an object to be treated is immersed in the inorganic acid-based treatment agent, or by spray treatment, in which an inorganic acid-based treatment agent is sprayed to an object to be treated.

According to the rustproofing method of the first embodiment of the present disclosure, an object to be treated has a temperature above 180° C., preferably above 220° C. when treated with the inorganic acid-based treatment agent. According to the rustproofing method of the second embodiment of the present disclosure, the temperature of an object to be treated when the object is treated with the inorganic acid-based treatment agent (an aqueous solution containing at least one selected from silicic acid, silicate, phosphoric acid, phosphate, monohydrogen phosphate, dihydrogen phosphate, and zirconium salt) is not particularly limited, and may be 180° C. or less. However, also in this case, an object to be treated preferably has a temperature above 180° C., and more preferably above 220° C. when treated with the inorganic acid-based treatment agent from the viewpoint of further improving the rust proof performance. Incidentally, depending on the type of a lubricant added, the friction coefficient of a surface of an article may decrease when the object to be treated has a high temperature, for example, when it exceeds 180° C. or a higher temperature.

According to the rustproofing method of both the first and second embodiments, the upper limit value of the temperature of an object to be treated when the object is treated with the inorganic acid-based treatment agent is not particularly limited, but is usually preferably 350° C. or less, more preferably 320° C. or less.

On the other hand, the temperature of the inorganic acid-based treatment agent used in treating an object to be treated is not particularly limited, and may be below the boiling point and above the freezing point of the inorganic acid-based treatment agent (an aqueous solution containing an inorganic acid or an inorganic salt), but is usually preferably about 15 to 50° C. from the viewpoint of cost and ease of operation.

The treating time of an object to be treated with the inorganic acid-based treatment agent (an aqueous solution containing an inorganic acid or an inorganic salt) (in the case of the immersion treatment, the time period for immersing an object to be treated in the inorganic acid-based treatment agent; and in the case of the spray treatment, the time period for spraying the inorganic acid-based treatment agent to the object to be treated) is not particularly limited because it may depend on the concentration of the inorganic acid-based treatment agent or the like. However, it is usually preferably 1 seconds or more, and more preferably 5 seconds or more. On the other hand, an object to be treated may be treated with the inorganic acid-based treatment agent for a long time, but from the viewpoint of the productivity and the efficiency, it is usually preferably 15 minutes or less, more preferably 10 minutes or less.

Note that, the treatment with the inorganic acid-based treatment agent may not be necessarily performed on all the surfaces of an object to be treated, but may be performed preferably on the whole surface or at least on a part of the surface that contains a metal or an alloy. For example, in the case of the immersion treatment, the whole object to be treated may be immersed in the inorganic acid-based treatment agent, or only the surface containing a metal or an alloy of the object may be immersed in the inorganic acid-based treatment agent. In the case of the spray treatment, the inorganic acid-based treatment agent may be sprayed on all the surfaces including a surface not containing a metal or an alloy, but it is only necessary to spray the inorganic acid-based treatment agent on the surface containing a metal or an alloy.

Note that the treatment with the inorganic acid-based treatment agent may be performed on all the surfaces simultaneously or on each surface sequentially. Further, all the surfaces of an object to be treated may be treated with the same inorganic acid-based treatment agent (an aqueous solution containing an inorganic acid or an inorganic salt), or may be treated with different ones.

Heating of an object to be treated and heating or cooling of the inorganic acid-based treatment agent can be performed by known means. The treatment with the inorganic acid-based treatment agent, specifically, the immersion treatment and the spray treatment can also be performed by known means. Further, the conditions of the treatment except for the temperature of an object to be treated, the temperature of the inorganic acid-based treatment agent, and the treating time are not particularly limited, and may be appropriately selected. In both the immersion treatment and the spray treatment, it is preferred that the entire surface containing a metal or an alloy be uniformly treated.

After an object to be treated is treated with the inorganic acid-based treatment agent (an aqueous solution containing an inorganic acid or an inorganic salt), the object may be subject to water washing or the like as necessary and dried, thereby obtaining an article having been subjected to the rustproofing treatment of the present disclosure.

Drying of an object to be treated having been treated with the inorganic acid-based treatment agent can be performed by known means, and the conditions of drying are not particularly limited and may be appropriately selected. For example, drying may be natural drying or air drying at ordinary temperature, or centrifugal drying. Drying may be carried out in the atmosphere, in an inert gas such as nitrogen gas, or under reduced pressure.

Although an object to be treated may be heated and dried, it is only necessary to remove the water solvent and it is not necessary to heat the object to be treated to a high temperature in the present disclosure. From the viewpoint of cost and ease of operation, it is usually preferable not to heat an object to be treated to a high temperature. Specifically, it is preferable not to include a step for heating an object to be treated to 200° C. or a higher temperature after treating the object with the inorganic acid-based treatment agent. It is more preferable not to include a step for heating an object to be treated to 150° C. or a higher temperature.

According to an embodiment, an object to be treated, to which the rustproofing method of the present disclosure is applied, has on a surface a film or a layer containing a metal or an alloy such as an antirust film that contains zinc, a zinc alloy, aluminum, or an aluminum alloy. Such film or layer containing a metal such as zinc, aluminum or alloys thereof can be formed by a known method. For example, it can be formed by applying a solution or a dispersion liquid that contains: metal particles or alloy particles; and a binder resin or a precursor thereof (a monomer or an oligomer which is polymerized or cured into a binder resin), to a surface of an object to be treated, then heating it to a high temperature to remove the solvent, and, in the case of a precursor of a binder resin, polymerizing or curing it. The heating temperature for forming a film or a layer that contains a metal or an alloy is often above 250° C. or may be above 300° C.

In the case of an object to be treated that has on a surface a film or a layer containing a metal or an alloy, after an article, which is an object to be treated, is heated to a temperature above 250° C. or even to a temperature above 300° C. to form a film or a layer containing a metal or an alloy on a surface as described above, the object to be treated may be treated with the inorganic acid-based treatment agent (an aqueous solution containing an inorganic acid or an inorganic salt) in a state where the object is not cooled so that it has a temperature above 250° C. or the object is slightly cooled naturally so that it has a temperature above 180° C. Implementing the rustproofing treatment of the present disclosure in such a manner is preferable because it eliminates the need to cool and reheat an object to be treated after forming a film or a layer containing a metal or an alloy on a surface, thereby shortening the process.

Note that there is no particular limitation on a method of forming the antirust film containing zinc, a zinc alloy, aluminum, or an aluminum alloy on a surface of an article to be treated. For example, the antirust film can be suitably formed by methods described in Japanese Patent Laid-Open No. 2005-200678 and Japanese Patent Laid-Open No. 2006-52361.

EXAMPLES

Hereinafter, the present disclosure will be described in more detail by way of Examples, but it is not limited thereto.

Example 1

By uniformly mixing the following components, a treatment agent for base coat that contains zinc flake as a main component was prepared.

Deionized water: 39.06% by mass
Zinc flake: 32.12% by mass
Aluminum flake: 5.08% by mass
DPG (dipropylene glycol): 10.29% by mass
Synperonic (registered trademark) 13/6.5: 3.15% by mass
Silquest (registered trademark) A187: 8.66% by mass
Schwego foam (registered trademark): 0.40% by mass
Nipar (registered trademark) S10: 0.71% by mass
Aerosol (registered trademark) TR70: 0.53% by mass The components listed above under the product names are as follows.

Synperonic (registered trademark) 13/6.5: polyoxyethylene (6.5) isotridecanol surfactant
Silquest (registered trademark) A187: γ-glycidoxypropyltrimethoxysilane
Schwego foam (registered trademark): defoamer
Nipar (registered trademark) S10: 1-nitropropane
Aerosol (registered trademark) TR70: anionic surfactant (bistridecyl sodium sulfosuccinate)

Further, as an immersion treatment agent, sodium silicate was dissolved in deionized water to prepare 150 ml of an aqueous solution containing 3% by mass of sodium silicate. The pH of the immersion treatment agent prepared was 11.4.

Next, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum. The deposition amount of the coating was 6 g/m$^2$. Hereinafter, this process of forming a coating containing zinc and aluminum will be referred to as "base treatment".

After it was confirmed that the surface temperature of the five bolts taken out of the electric furnace was between 265° C. and 300° C. using an infrared thermometer, the bolts were immersed in the 150 ml of the aqueous solution containing 3% by mass of sodium silicate at a solution temperature of 20° C. for about 10 seconds. The bolts were then taken out and dried to prepare five bolts having been subjected to the base treatment and the immersion treatment.

The five bolts thus prepared, which had been subjected to the base treatment (the deposition amount of the coating: 6 g/m$^2$) and the immersion treatment (aqueous solution of sodium silicate; the surface temperature of the bolts: 265° C. to 300° C.), were then subjected to a salt spray test in accordance with JIS Z-2371. It was confirmed whether the bolts had rusted every 168 hours from the start of the test to evaluate the corrosion resistance. As a result, the formation of rust was not confirmed for all five bolts at 840 hours from the start of the salt spray test, and the formation of rust was confirmed only on one bolt at 1008 hours from the start of the test.

Comparative Example 1

Five bolts having been subjected only to the base treatment were prepared in the same manner as in Example 1, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 6 g/m$^2$), were then subjected to a salt spray test in accordance with JIS Z-2371 in the same manner as in Example 1 to evaluate the corrosion resistance. As a result, the formation of rust was confirmed on two of the five bolts at 168 hours from the start of the salt spray test. At 336 hours from the start of the test, the formation of rust was confirmed on three or more bolts, which was more than half of the five bolts.

Example 2

Five bolts having been subjected to the base treatment and the immersion treatment were prepared in the same manner as in Example 1, except that the rotational frequency of the centrifugal shaking in the dip spin method in the base treatment was changed so as to change the deposition amount of the coating containing zinc and aluminum to 8 g/m$^2$.

The five bolts thus prepared, which had been subjected to the base treatment (the deposition amount of the coating: 8 g/m$^2$) and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test.

Comparative Example 2

Five bolts having been subjected only to the base treatment were prepared in the same manner as in Example 2, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 8 g/m$^2$), were then subjected to a salt spray test in accordance with JIS Z-2371 in the same manner as in Example 1 to evaluate the corrosion resistance. As a result, the formation of rust was confirmed on two of the five bolts at 168 hours from the start of the salt spray test. At 336 hours from the start of the test, the formation of rust was confirmed on three or more bolts, which was more than half of the five bolts.

Example 3

Five bolts having been subjected to the base treatment and the immersion treatment were prepared in the same manner as in Example 1, except that the rotational frequency of the centrifugal shaking in the dip spin method in the base treatment was changed so as to change the deposition amount of the coating containing zinc and aluminum to 10 g/m$^2$.

The five bolts thus prepared, which had been subjected to the base treatment (the deposition amount of the coating: 10 g/m$^2$) and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test.

Comparative Example 3

Five bolts having been subjected only to the base treatment were prepared in the same manner as in Example 3, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 10 g/m$^2$), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on three or more bolts, which was more than half of the five bolts, at 336 hours from the start of the test.

Example 4

Five bolts having been subjected to the base treatment and the immersion treatment were prepared in the same manner as in Example 1, except that the rotational frequency of the centrifugal shaking in the dip spin method in the base treatment was changed so as to change the deposition amount of the coating containing zinc and aluminum to 12 g/m$^2$.

The five bolts thus prepared, which had been subjected to the base treatment (the deposition amount of the coating: 12 g/m$^2$) and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test. At 1176 hours from the start of the test, the formation of rust was not confirmed for all five bolts. The formation of rust was confirmed only on one bolt at 1344 hours from the start of the test. At 2016 hours from the start of the test, the formation of rust was confirmed only on the one bolt.

Comparative Example 4

Five bolts having been subjected only to the base treatment were prepared in the same manner as in Example 4, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 12 g/m$^2$), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on two bolts at 336 hours from the start of the test. At 504 hours from the start of the test, the formation of rust was confirmed on three or more bolts, which was more than half of the five bolts.

Example 5

As an immersion treatment agent, sodium silicate was dissolved in deionized water to prepare 150 ml of an aqueous solution containing 0.1% by mass of sodium silicate. The pH of the immersion treatment agent prepared was 10.2. Five bolts having been subjected to the base treatment and the immersion treatment were prepared in the same manner as in Example 4, except that the immersion treatment was performed using the 150 ml of the aqueous solution containing 0.1% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 $g/m^2$) and the immersion treatment (aqueous solution containing 0.1% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test.

Example 6

As an immersion treatment agent, sodium silicate was dissolved in deionized water to prepare 150 ml of an aqueous solution containing 0.3% by mass of sodium silicate. The pH of the immersion treatment agent prepared was 10.3. Five bolts having been subjected to the base treatment and the immersion treatment were prepared in the same manner as in Example 4, except that the immersion treatment was performed using the 150 ml of the aqueous solution containing 0.3% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 $g/m^2$) and the immersion treatment (aqueous solution containing 0.3% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test. At 1008 hours from the start of the test, the formation of rust was confirmed on one bolt. Also at 1344 hours from the start of the test, the formation of rust was confirmed only on the one bolt.

Example 7

As an immersion treatment agent, sodium silicate was dissolved in deionized water to prepare 150 ml of an aqueous solution containing 0.5% by mass of sodium silicate. The pH of the immersion treatment agent prepared was 10.9. Five bolts having been subjected to the base treatment and the immersion treatment were prepared in the same manner as in Example 4, except that the immersion treatment was performed using the 150 ml of the aqueous solution containing 0.5% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 $g/m^2$) and the immersion treatment (aqueous solution containing 0.5% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1680 hours from the start of the salt spray test. At 1848 hours from the start of the test, the formation of rust was confirmed on one bolt. Also at 2016 hours from the start of the test, the formation of rust was confirmed only on the one bolt.

Example 8

As an immersion treatment agent, sodium silicate was dissolved in deionized water to prepare 150 ml of an aqueous solution containing 1% by mass of sodium silicate. The pH of the immersion treatment agent prepared was 11.1. Five bolts having been subjected to the base treatment and the immersion treatment were prepared in the same manner as in Example 4, except that the immersion treatment was performed using the 150 ml of the aqueous solution containing 1% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 $g/m^2$) and the immersion treatment (aqueous solution containing 1% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2148 hours from the start of the salt spray test.

Example 9

As an immersion treatment agent, sodium silicate was dissolved in deionized water to prepare 150 ml of an aqueous solution containing 5% by mass of sodium silicate. The pH of the immersion treatment agent prepared was 11.5. Five bolts having been subjected to the base treatment and the immersion treatment were prepared in the same manner as in Example 4, except that the immersion treatment was performed using the 150 ml of the aqueous solution containing 5% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 $g/m^2$) and the immersion treatment (aqueous solution containing 5% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test.

Example 10

As an immersion treatment agent, sodium silicate was dissolved in deionized water to prepare 150 ml of an aqueous solution containing 10% by mass of sodium silicate. The pH of the immersion treatment agent prepared was 11.6. Five bolts having been subjected to the base treatment and the immersion treatment were prepared in the same manner as in Example 4, except that the immersion treatment was performed using the 150 ml of the aqueous solution containing 10% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution containing 10% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1680 hours from the start of the salt spray test. At 1848 hours from the start of the test, the formation of rust was confirmed on one bolt. Also at 2016 hours from the start of the test, the formation of rust was confirmed only on the one bolt.

Example 11

As an immersion treatment agent, sodium silicate was dissolved in deionized water to prepare 150 ml of an aqueous solution containing 15% by mass of sodium silicate. The pH of the immersion treatment agent prepared was 11.6. Five bolts having been subjected to the base treatment and the immersion treatment were prepared in the same manner as in Example 4, except that the immersion treatment was performed using the 150 ml of the aqueous solution containing 15% by mass of sodium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution containing 15% by mass of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1680 hours from the start of the salt spray test. At 1848 hours from the start of the test, the formation of rust was confirmed on one bolt. Also at 2016 hours from the start of the test, the formation of rust was confirmed only on the one bolt.

Example 12

As an immersion treatment agent, sodium dihydrogen phosphate was dissolved in deionized water to prepare 150 ml of an aqueous solution containing 5% by mass of sodium dihydrogen phosphate. The pH of the immersion treatment agent prepared was 4.3. Five bolts having been subjected to the base treatment and the immersion treatment were prepared in the same manner as in Example 4, except that the immersion treatment was performed using the 150 ml of the aqueous solution containing 5% by mass of sodium dihydrogen phosphate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of sodium dihydrogen phosphate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test.

Example 13

As an immersion treatment agent, ammonium zirconium carbonate ("Bacote 20" [product name] available from Nippon Light Metal Company, Ltd.) was dissolved in deionized water to prepare 150 ml of an aqueous solution containing 5% by mass of ammonium zirconium carbonate. The pH of the immersion treatment agent prepared was 9.2. Five bolts having been subjected to the base treatment and the immersion treatment were prepared in the same manner as in Example 4, except that the immersion treatment was performed using the 150 ml of the aqueous solution containing 5% by mass of ammonium zirconium carbonate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of ammonium zirconium carbonate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test, and the formation of rust was confirmed only on one bolt at 1176 hours from the start of the test.

Example 14

As an immersion treatment agent, sodium nitrate was dissolved in deionized water to prepare 150 ml of an aqueous solution containing 5% by mass of sodium nitrate. The pH of the immersion treatment agent prepared was 6.8. Five bolts having been subjected to the base treatment and the immersion treatment were prepared in the same manner as in Example 4, except that the immersion treatment was performed using the 150 ml of the aqueous solution containing 5% by mass of sodium nitrate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of sodium nitrate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on one bolt at 672 hours from the start of the test.

Example 15

As an immersion treatment agent, potassium sulfate was dissolved in deionized water to prepare 150 ml of an aqueous solution containing 5% by mass of potassium sulfate. The pH of the immersion treatment agent prepared was 5.8. Five bolts having been subjected to the base treatment and the immersion treatment were prepared in the same manner as in Example 4, except that the immersion treatment was performed using the 150 ml of the aqueous solution containing 5% by mass of potassium sulfate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of potassium sulfate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test.

Example 16

As an immersion treatment agent, sodium molybdate was dissolved in deionized water to prepare 150 ml of an aqueous solution containing 5% by mass of sodium molybdate. The pH of the immersion treatment agent prepared was 8.1. Five bolts having been subjected to the base treatment and the immersion treatment were prepared in the same manner as in Example 4, except that the immersion treatment was performed using the 150 ml of the aqueous solution containing 5% by mass of sodium molybdate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of sodium molybdate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on one bolt at 504 hours from the start of the test.

Comparative Example 5

As an immersion treatment agent, a silane coupling agent ("A187T" available from Momentive Performance Materials Japan Co., Ltd.) was dissolved in deionized water to prepare 150 ml of an aqueous solution containing 5% by mass of the silane coupling agent. Five bolts having been subjected to the base treatment and the immersion treatment were prepared in the same manner as in Example 4, except that the immersion treatment was performed using the 150 ml of the aqueous solution containing 5% by mass of the silane coupling agent at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 12 g/m$^2$) and the immersion treatment (aqueous solution of the silane coupling agent; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on one bolt at 336 hours from the start of the test. At 504 hours from the start of the test, the formation of rust was confirmed on three or more bolts, which was more than half of the five bolts.

Example 17

Five bolts having been subjected to the base treatment and the immersion treatment were prepared in the same manner as in Example 1, except that the rotational frequency of the centrifugal shaking in the dip spin method in the base treatment was changed so as to change the deposition amount of the coating containing zinc and aluminum to 14 g/m$^2$.

The five bolts thus prepared, which had been subjected to the base treatment (the deposition amount of the coating: 14 g/m$^2$) and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test.

Comparative Example 6

Five bolts having been subjected only to the base treatment were prepared in the same manner as in Example 17, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 14 g/m$^2$), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on two bolts at 336 hours from the start of the test. At 504 hours from the start of the test, the formation of rust was confirmed on three or more bolts, which was more than half of the five bolts.

Example 18

As an immersion treatment agent, sodium dihydrogen phosphate was dissolved in deionized water to prepare 150 ml of an aqueous solution containing 5% by mass of sodium dihydrogen phosphate. The pH of the immersion treatment agent prepared was 4.3. Five bolts having been subjected to the base treatment and the immersion treatment were prepared in the same manner as in Example 17, except that the immersion treatment was performed using the 150 ml of the aqueous solution containing 5% by mass of sodium dihydrogen phosphate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 14 g/m$^2$) and the immersion treatment (aqueous solution of sodium dihydrogen phosphate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test.

Example 19

As an immersion treatment agent, potassium sulfate was dissolved in deionized water to prepare 150 ml of an aqueous solution containing 5% by mass of potassium sulfate. The pH of the immersion treatment agent prepared was 5.8. Five bolts having been subjected to the base treatment and the immersion treatment were prepared in the same manner as in Example 17, except that the immersion treatment was performed using the 150 ml of the aqueous solution containing 5% by mass of potassium sulfate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 14 g/m$^2$) and the immersion treatment (aqueous solution of potassium sulfate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test.

Comparative Example 7

As an immersion treatment agent, sodium citrate was dissolved in deionized water to prepare 150 ml of an aqueous solution containing 5% by mass of sodium citrate. Five bolts having been subjected to the base treatment and the immersion treatment were prepared in the same manner as in Example 17, except that the immersion treatment was performed using the 150 ml of the aqueous solution containing 5% by mass of sodium citrate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 14 g/m$^2$) and the immersion treatment (aqueous solution of sodium citrate; the surface temperature of the bolts: 265° C. to 300° C.), were then subjected to a salt spray test in accordance with JIS Z-2371 in the same manner as in Example 1 to evaluate the corrosion resistance. As a result, the formation of rust was confirmed on three or more bolts, which was more than half of the five bolts, at 168 hours from the start of the test.

Example 20

Five bolts having been subjected to the base treatment and the immersion treatment were prepared in the same manner as in Example 1, except that the rotational frequency of the centrifugal shaking in the dip spin method in the base treatment was changed so as to change the deposition amount of the coating containing zinc and aluminum to 18 g/m$^2$.

The five bolts thus prepared, which had been subjected to the base treatment (the deposition amount of the coating: 18 g/m$^2$) and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1008 hours from the start of the salt spray test. Also at 1848 hours from the start of the test, the formation of rust was not confirmed for all five bolts. The formation of rust was confirmed only on one bolt at 2016 hours from the start of the test.

Comparative Example 8

Five bolts having been subjected only to the base treatment were prepared in the same manner as in Example 20, except that after the base treatment, the immersion treatment with the aqueous solution containing 3% by mass of sodium silicate was not performed and the bolts were cooled to room temperature as they were.

The five bolts thus prepared, which had been subjected only to the base treatment (the deposition amount of the coating: 18 g/m$^2$), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, but the formation of rust was confirmed on three or more bolts, which was more than half of the five bolts, at 672 hours from the start of the test.

Example 21

As an immersion treatment agent, lithium silicate was dissolved in deionized water to prepare 150 ml of an aqueous solution containing 3% by mass of lithium silicate. The pH of the immersion treatment agent prepared was 11.0. Five bolts having been subjected to the base treatment and the immersion treatment were prepared in the same manner as in Example 20, except that the immersion treatment was performed using the 150 ml of the aqueous solution containing 3% by mass of lithium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 18 g/m$^2$) and the immersion treatment (aqueous solution of lithium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2148 hours from the start of the salt spray test. At 2352 hours from the start of the test, the formation of rust was confirmed on one bolt.

Example 22

As an immersion treatment agent, potassium silicate was dissolved in deionized water to prepare 150 ml of an aqueous solution containing 3% by mass of potassium silicate. The pH of the immersion treatment agent prepared was 11.4. Five bolts having been subjected to the base treatment and the immersion treatment were prepared in the same manner as in Example 20, except that the immersion treatment was performed using the 150 ml of the aqueous solution containing 3% by mass of potassium silicate at a solution temperature of 20° C. in place of the 150 ml of the aqueous solution containing 3% by mass of sodium silicate at a solution temperature of 20° C.

The five bolts thus prepared, which had been subjected to the base treatment (the deposition amount of the coating: 18 g/m$^2$) and the immersion treatment (aqueous solution of potassium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1848 hours from the start of the salt spray test. At 2016 hours from the start of the test, the formation of rust was confirmed on one bolt. Also at 2352 hours from the start of the test, the formation of rust was confirmed only on the one bolt.

Example 23

After the base treatment was performed in the same manner as in Example 4, it was confirmed that the surface temperature of the five bolts taken out of the electric furnace was between 265° C. and 300° C. using an infrared thermometer, and the bolts were immersed in the 150 ml of the aqueous solution containing 3% by mass of sodium silicate at a solution temperature of 0° C. for about 60 seconds. The bolts were then taken out and dried to prepare five bolts having been subjected to the base treatment and the immersion treatment.

The five bolts thus prepared, which had been subjected to the base treatment (the deposition amount of the coating: 12 g/m$^2$) and the immersion treatment (aqueous solution of sodium silicate at 0° C.; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1680 hours from the start of the test.

Example 24

Five bolts having been subjected to the base treatment and the immersion treatment were prepared in the same manner as in Example 23, except that the solution temperature of the immersion treatment agent, i.e., the aqueous solution containing 3% by mass of sodium silicate was changed to 50° C.

The five bolts thus prepared, which had been subjected to the base treatment (the deposition amount of the coating: 12 g/m$^2$) and the immersion treatment (aqueous solution of sodium silicate at 50° C.; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1680 hours from the start of the test.

Example 25

Five bolts having been subjected to the base treatment and the immersion treatment were prepared in the same manner as in Example 23, except that the solution temperature of the immersion treatment agent, i.e., the aqueous solution containing 3% by mass of sodium silicate was changed to 90° C.

The five bolts thus prepared, which had been subjected to the base treatment (the deposition amount of the coating: 12 g/m$^2$) and the immersion treatment (aqueous solution of sodium silicate at 90° C.; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test.

Example 26

After the base treatment was performed in the same manner as in Example 4, it was confirmed that the surface temperature of the five bolts taken out of the electric furnace was between 265° C. and 300° C. using an infrared thermometer, and the bolts were immersed in the 150 ml of the aqueous solution containing 3% by mass of sodium dihydrogen phosphate at a solution temperature of 0° C. for about 60 seconds. The bolts were then taken out and dried to prepare five bolts having been subjected to the base treatment and the immersion treatment.

The five bolts thus prepared, which had been subjected to the base treatment (the deposition amount of the coating: 12 g/m$^2$) and the immersion treatment (aqueous solution of sodium dihydrogen phosphate at 0° C.; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1680 hours from the start of the test.

Example 27

Five bolts having been subjected to the base treatment and the immersion treatment were prepared in the same manner as in Example 26, except that the solution temperature of the immersion treatment agent, i.e., the aqueous solution containing 3% by mass of sodium dihydrogen phosphate was changed to 50° C.

The five bolts thus prepared, which had been subjected to the base treatment (the deposition amount of the coating: 12 g/m$^2$) and the immersion treatment (aqueous solution of sodium dihydrogen phosphate at 50° C.; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test, and the formation of rust was confirmed only on one bolt at 1176 hours from the start of the test.

Example 28

After the base treatment was performed in the same manner as in Example 4, it was confirmed that the surface temperature of the five bolts taken out of the electric furnace was between 265° C. and 300° C. using an infrared thermometer, and the bolts were immersed in the aqueous solution containing 3% by mass of sodium silicate of which weight is 1 times the total weight of the bolts to be immersed at a solution temperature of 25° C. for about 10 seconds. The bolts were then taken out and dried to prepare five bolts having been subjected to the base treatment and the immersion treatment.

The five bolts thus prepared, which had been subjected to the base treatment (the deposition amount of the coating: 12 g/m$^2$) and the immersion treatment (sodium silicate aqueous solution that has the weight 1 times the total weight of the bolts; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2352 hours from the start of the salt spray test.

Example 29

Five bolts having been subjected to the base treatment and the immersion treatment were prepared in the same manner as in Example 28, except that the amount used of the immersion treatment agent, i.e., the aqueous solution containing 3% by mass of sodium silicate was changed to an amount weighing 3 times the total weight of the bolts.

The five bolts thus prepared, which had been subjected to the base treatment (the deposition amount of the coating: 12 g/m$^2$) and the immersion treatment (sodium silicate aqueous solution that has the weight 3 times the total weight of the bolts; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2352 hours from the start of the salt spray test.

Example 30

Five bolts having been subjected to the base treatment and the immersion treatment were prepared in the same manner as in Example 28, except that the amount used of the immersion treatment agent, i.e., the aqueous solution containing 3% by mass of sodium silicate was changed to an amount weighing 5 times the total weight of the bolts.

The five bolts thus prepared, which had been subjected to the base treatment (the deposition amount of the coating: 12 g/m$^2$) and the immersion treatment (sodium silicate aqueous solution that has the weight 5 times the total weight of the bolts; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2520 hours from the start of the salt spray test.

Example 31

Five bolts having been subjected to the base treatment and the immersion treatment were prepared in the same manner as in Example 28, except that the amount used of the immersion treatment agent, i.e., the aqueous solution containing 3% by mass of sodium silicate was changed to an amount weighing 10 times the total weight of the bolts.

The five bolts thus prepared, which had been subjected to the base treatment (the deposition amount of the coating: 12 g/m$^2$) and the immersion treatment (sodium silicate aqueous solution that has the weight 10 times the total weight of the bolts; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 2016 hours from the start of the salt spray test, and the formation of rust was confirmed only on one bolt at 2352 hours from the start of the test.

Comparative Example 9

A treatment agent for base coat that contains zinc flake as a main component was prepared in the same manner as in Example 1.

Next, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum. The deposition amount of the coating was 12 g/m$^2$. Hereinafter, this process of forming a coating containing zinc and aluminum will be referred to as "base treatment".

The five bolts taken out of the electric furnace were cooled to room temperature as they were to prepare five bolts having been subjected only to the base treatment.

The five bolts thus prepared, which had been subjected only to the base treatment, were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on two bolts at 336 hours from the test. The formation of rust was confirmed on three or more bolts, which was more than half of the five bolts, at 504 hours from the start of the test.

Example 32

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, the five bolts taken out of the electric furnace were cooled to room temperature (about 25° C.) as they were and then immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: room temperature [about 25° C.]), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test, and the formation of rust was confirmed only on two bolts at 840 hours from the start of the test.

Example 33

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 35° C. and 60° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 35° C. to 60° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test, and the formation of rust was confirmed only on two bolts at 1008 hours from the start of the test.

Example 34

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 65° C. and 100° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 65° C. to 100° C.), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test, and the formation of rust was confirmed only on two bolts at 840 hours from the start of the test.

Example 35

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 105° C. and 140° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 105° C. to 140° C.), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test, and the formation of rust was confirmed only on two bolts at 840 hours from the start of the test.

Example 36

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test, and the formation of rust was confirmed only on one bolt at 840 hours from the start of the test. Also at 1008 hours from the start of the test, the formation of rust was confirmed only on the one bolt.

Example 37

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 185° C. and 220° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 185° C. to 220° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1344 hours from the start of the test.

Example 38

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 225° C. to 260° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1344 hours from the start of the test.

Example 39

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 265° C. and 300° C. using an infrared thermometer, and the bolts were immersed in the 150 ml of the aqueous solution containing 3% by mass of sodium silicate (pH 11.5) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium silicate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test, and the formation of rust was confirmed only on one bolt at 1344 hours from the start of the test.

Example 40

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, the five bolts taken out of the electric furnace were cooled to room temperature (about 25° C.) as they were and then immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: room temperature [about 25° C.]), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on two bolts at 504 hours from the start of the test.

Example 41

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 35° C. and 60° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 35° C. to 60° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on two bolts at 504 hours from the start of the test.

Example 42

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 65° C. and 100° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 65° C. to 100° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on one bolt at 504 hours from the start of the test. The formation of rust was confirmed only on two bolts at 672 hours from the start of the test.

Example 43

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 105° C. and 140° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 105° C. to 140° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on two bolts at 672 hours from the start of the test.

Example 44

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on one bolt at 840 hours from the start of the test. The formation of rust was confirmed only on two bolts at 1008 hours from the start of the test.

Example 45

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 185° C. and 220° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 185° C. to 220° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test.

Example 46

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 225° C. to 260° C.), were then subjected to a salt spray test in accordance with JIS Z-2371 in the same manner as in Example 1 to evaluate the corrosion resistance. As a result, the formation of rust was not confirmed for all five bolts at 672 hours from the start of the salt spray test, and the formation of rust was confirmed only on one bolt at 840 hours from the start of the test.

Example 47

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 265° C. and 300° C. using an infrared thermometer, and the bolts were immersed in the 150 ml of the aqueous solution containing 3% by mass of sodium dihydrogen phosphate (pH 4.4) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium dihydrogen phosphate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test.

Example 48

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 65° C. and 100° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 65° C. to 100° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on one bolt at 504 hours from the start of the test. The formation of rust was confirmed only on two bolts at 672 hours from the start of the test.

Example 49

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 105° C. and 140° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 105° C. to 140° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on two bolts at 672 hours from the start of the test.

Example 50

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test, and the formation of rust was confirmed only on one bolt at 1008 hours from the start of the test.

Example 51

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 840 hours from the start of the salt spray test, and the formation of rust was confirmed only on one bolt at 1008 hours from the start of the test.

Example 52

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 225° C. to 260° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test.

Example 53

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 265° C. and 300° C. using an infrared thermometer, and the bolts were immersed in the 150 ml of the aqueous solution containing 5% by mass of ammonium zirconium carbonate (pH 9.1) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of ammonium zirconium carbonate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 1176 hours from the start of the salt spray test.

Comparative Example 10

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 5% by mass of potassium sulfate (pH 5.8) at a solution temperature of 25° C. for about 10 seconds.

The bolts were then taken out and dried to prepare five bolts having been subjected to the base treatment and the immersion treatment.

The five bolts thus prepared, which had been subjected to the base treatment and the immersion treatment (aqueous solution of potassium sulfate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on one bolt at 336 hours from the start of the test. The formation of rust was confirmed on two or more bolts at 504 hours from the start of the test.

Example 54

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 5% by mass of potassium sulfate (pH 5.8) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of potassium sulfate; the surface temperature of the bolts: 225° C. to 260° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on one bolt at 504 hours from the start of the test. The formation of rust was confirmed only on two bolts at 672 hours from the start of the test.

Example 55

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 265° C. and 300° C. using an infrared thermometer, and the bolts were immersed in the 150 ml of the aqueous solution containing 5% by mass of potassium sulfate (pH 5.8) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of potassium sulfate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on one bolt at 672 hours from the start of the test.

Comparative Example 11

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 145° C. and 180° C. using an infrared thermometer, and the bolts were immersed in the 150 ml of the aqueous solution containing 5% by mass of sodium nitrate (pH 6.8) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium nitrate; the surface temperature of the bolts: 145° C. to 180° C.), were then subjected to a salt spray test in accordance with JIS Z-2371 in the same manner as in Example 1 to evaluate the corrosion resistance. As a result, the formation of rust was not confirmed for all five bolts at 168 hours from the start of the salt spray test, but the formation of rust was confirmed on one bolt at 336 hours from the start of the test. The formation of rust was confirmed on two or more bolts at 672 hours from the start of the test.

Example 56

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 5% by mass of sodium nitrate (pH 6.8) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium nitrate; the surface temperature of the bolts: 225° C. to 260° C.), were then subjected to a salt spray test in accordance with JIS Z-2371 in the same manner as in Example 1 to evaluate the corrosion resistance. As a result, the formation of rust was not confirmed for all five bolts at 336 hours from the start of the salt spray test, and the formation of rust was confirmed only on one bolt at 504 hours from the start of the test. The formation of rust was confirmed only on two bolts at 672 hours from the start of the test.

Example 57

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 265° C. and 300° C. using an infrared thermometer, and the bolts were immersed in the 150 ml of the aqueous solution containing 5% by mass of sodium nitrate (pH 6.8) at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium nitrate; the surface temperature of the bolts: 265° C. to 300° C.), were then subjected to a salt spray test in accordance with JIS Z-2371 in the same manner as in Example 1 to evaluate the corrosion resistance. As a result, the formation of rust was not confirmed for all five bolts at 504 hours from the start of the salt spray test, and the formation of rust was confirmed only on one bolt at 672 hours from the start of the test.

Comparative Example 12

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, the five bolts taken out of the electric furnace were cooled to room temperature (about 25° C.) as they were and then immersed in the 150 ml of the aqueous solution containing 5% by mass of sodium citrate at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium citrate; the surface temperature of the bolts: room temperature [about 25° C.]), were then subjected to a salt spray test in accordance with JIS Z-2371 in the same manner as in Example 1 to evaluate the corrosion resistance. As a result, the formation of rust was confirmed on one of the five bolts at 168 hours from the start of the salt spray test. At 336 hours from the start of the test, the formation of rust was confirmed on two bolts.

Comparative Example 13

In the same manner as in Comparative Example 9, five hexagon flange bolts with a size of M6, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum.

Thereafter, it was confirmed that the surface temperature of the five bolts taken out of the electric furnace was between 225° C. and 260° C. using an infrared thermometer, and the bolts were immersed in the 150 ml of the aqueous solution containing 5% by mass of sodium citrate at a solution temperature of 25° C. for about 10 seconds. The bolts were then taken out and dried to prepare five bolts having been subjected to the base treatment and the immersion treatment.

The five bolts thus prepared, which had been subjected to the base treatment and the immersion treatment (aqueous solution of sodium citrate; the surface temperature of the bolts: 225° C. to 260° C.), were then subjected to a salt spray test in accordance with JIS Z-2371 in the same manner as in Example 1 to evaluate the corrosion resistance. As a result, the formation of rust was confirmed on one of the five bolts at 168 hours from the start of the salt spray test. At 336 hours from the start of the test, the formation of rust was confirmed on two bolts.

Example 58

As an immersion treatment agent, sodium silicate was dissolved in deionized water to prepare an aqueous solution containing 5% by mass of sodium silicate. The pH of the immersion treatment agent prepared was 11.4 (20° C.).

Next, a cold rolled steel sheet with a size of 150 mm×70 mm×0.8 mm was degreased with dichloromethane, and then heated in an electric furnace at 330° C. for 15 minutes. After it was confirmed that the surface temperature of the cold rolled steel sheet taken out of the electric furnace was between 265° C. and 300° C. using an infrared thermometer, the cold rolled steel sheet were immersed in the 150 ml of the aqueous solution containing 5% by mass of sodium silicate at a solution temperature of 20° C. for about 10 seconds, and then taken out and dried.

The cold rolled steel sheet, which had been thus subjected to the immersion treatment, was then subjected to a salt spray test in accordance with JIS Z-2371 to evaluate the corrosion resistance. FIGS. 1A and 1B are photographs of the cold rolled steel sheet that had been subjected to the immersion treatment, at 1 hour and 5 hours from the start of the salt spray test, respectively.

Comparative Example 14

A cold rolled steel sheet for evaluation of the corrosion resistance was prepared in the same manner as in Example 58, except that after the heating in an electric furnace at 330° C. for 15 minutes, the immersion treatment with the aqueous solution of sodium silicate was not performed and the sheet was cooled to room temperature as it was.

The cold rolled steel sheet that had not been subjected to the immersion treatment was then subjected to a salt spray test in accordance with JIS Z-2371 to evaluate the corrosion resistance. FIGS. 2A and 2B are photographs of the cold rolled steel sheet that had been subjected to the immersion treatment, at 1 hour and 5 hours from the start of the salt spray test, respectively.

The cold rolled steel sheet of Example 58, which had been subjected to the immersion treatment with the aqueous solution of sodium silicate, prevented rust as compared with the cold rolled steel sheet of Comparative Example 14, which had not been subjected to the immersion treatment.

Example 59

By uniformly mixing the following components, a treatment agent for base coat that contains zinc flake as a main component was prepared.

Deionized water: 39.06% by mass
Zinc flake: 32.12% by mass
Aluminum flake: 5.08% by mass
DPG (dipropylene glycol): 10.29% by mass
Synperonic (registered trademark) 13/6.5: 3.15% by mass
Silquest (registered trademark) A187: 8.66% by mass
Schwego foam (registered trademark): 0.40% by mass
Nipar (registered trademark) S10: 0.71% by mass
Aerosol (registered trademark) TR70: 0.53% by mass The components listed above under the product names are as follows.

Synperonic (registered trademark) 13/6.5: polyoxyethylene (6.5) isotridecanol surfactant Silquest (registered trademark) A187: γ-glycidoxypropyltrimethoxy silane Schwego foam (registered trademark): defoamer Nipar (registered trademark) S10: 1-nitropropane Aerosol (registered trademark) TR70: anionic surfactant (bistridecyl sodium sulfosuccinate)

Further, as an immersion treatment agent, sodium silicate was dissolved in deionized water so as to include 1% by mass of sodium silicate to prepare 1000 ml of an aqueous solution containing 1% by mass of sodium silicate.

Next, five hexagon flange bolts with a size of M10, which had been subjected to vapor degreasing with dichloromethane and shot blasting, were coated with the treatment agent for base coat by an immersion method involving centrifugal shaking (a dip spin method), preheated at 100° C. for 10 minutes in an electric furnace, and baked at 330° C. for 30 minutes in an electric furnace to form a coating containing zinc and aluminum. The deposition amount of the coating was 14 g/m$^2$. Hereinafter, this process of forming a coating containing zinc and aluminum will be referred to as "base treatment".

After it was confirmed that the surface temperature of the five bolts taken out of the electric furnace was between 185° C. and 220° C. using an infrared thermometer, the bolts were immersed in the 1000 ml of the aqueous solution containing 1% by mass of sodium silicate at a solution temperature of 20° C. for about 1 minute. The bolts were then taken out and dried to prepare five bolts having been subjected to the base treatment and the immersion treatment.

The five bolts thus prepared, which had been subjected to the base treatment and the immersion treatment (aqueous solution containing 1% by mass of sodium silicate; the surface temperature of the bolts: 185° C. to 220° C.), were then subjected to a measurement of the friction coefficient of the surface in accordance with ISO16047 HH method to calculate the average value of the friction coefficient. The average friction coefficient was 0.243.

The five bolts thus prepared, which had been subjected to the base treatment and the immersion treatment (aqueous solution containing 1% by mass of sodium silicate; the surface temperature of the bolts: 185° C. to 220° C.), were then subjected to a salt spray test in accordance with JIS Z-2371. It was confirmed whether the bolts had rusted every 168 hours from the start of the test to evaluate the corrosion resistance. As a result, the formation of rust was not confirmed for all five bolts at 1176 hours from the start of the salt spray test, and the formation of rust was confirmed only on one bolt at 1344 hours from the start of the test.

Example 60

As an immersion treatment agent, sodium silicate and a lubricant, "AQUACER 593" (product name) available from BYK Corporation (hereinafter, referred to as "lubricant a") were dissolved and mixed in deionized water so as to include 1% by mass of sodium silicate and 1% by mass of the lubricant a to prepare 1000 ml of an aqueous solution containing 1% by mass of sodium silicate and 1% by mass of the lubricant a. Five bolts having been subjected to the base treatment and the immersion treatment were prepared in the same manner as in Example 59, except that the immersion treatment was performed using the 1000 ml of the aqueous solution containing 1% by mass of sodium silicate and 1% by mass of the lubricant a at a solution temperature of 20° C. in place of the 1000 ml of the aqueous solution containing 1% by mass of sodium silicate at a solution temperature of 20° C. Note that the lubricant a ("AQUACER 593" available from BYK Corporation) is an aqueous emulsion including a modified polypropylene wax as a base.

The five bolts thus prepared, which had been subjected to the base treatment and the immersion treatment (aqueous solution containing 1% by mass of sodium silicate and 1% by mass of the lubricant a; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.173.

The five bolts thus prepared, which had been subjected to the base treatment and the immersion treatment (aqueous solution containing 1% by mass of sodium silicate and 1% by mass of the lubricant a; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1176 hours from the start of the salt spray test.

Example 61

As an immersion treatment agent, sodium silicate and a lubricant, "AQUACER 593" (product name) available from BYK Corporation (the lubricant a) were dissolved and mixed in deionized water so as to include 1% by mass of sodium silicate and 5% by mass of the lubricant a to prepare 1000 ml of an aqueous solution containing 1% by mass of sodium silicate and 5% by mass of the lubricant a. Five bolts having been subjected to the base treatment and the immersion treatment were prepared in the same manner as in Example 59, except that the immersion treatment was performed using the 1000 ml of the aqueous solution containing 1% by mass of sodium silicate and 5% by mass of the lubricant a at a solution temperature of 20° C. in place of the 1000 ml of the aqueous solution containing 1% by mass of sodium silicate at a solution temperature of 20° C.

The five bolts thus prepared, which had been subjected to the base treatment and the immersion treatment (aqueous solution containing 1% by mass of sodium silicate and 5% by mass of the lubricant a; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.154.

The five bolts thus prepared, which had been subjected to the base treatment and the immersion treatment (aqueous solution containing 1% by mass of sodium silicate and 5% by mass of the lubricant a; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1176 hours from the start of the salt spray test.

Example 62

As an immersion treatment agent, sodium silicate and a lubricant, "AQUACER 497" (product name) available from BYK Corporation (hereinafter, referred to as "lubricant b") were dissolved and mixed in deionized water so as to include 1% by mass of sodium silicate and 3% by mass of the lubricant b to prepare 1000 ml of an aqueous solution containing 1% by mass of sodium silicate and 3% by mass of the lubricant b. Five bolts having been subjected to the base treatment and the immersion treatment were prepared in the same manner as in Example 59, except that the immersion treatment was performed using the 1000 ml of the aqueous solution containing 1% by mass of sodium silicate and 3% by mass of the lubricant b at a solution temperature of 20° C. in place of the 1000 ml of the aqueous solution containing 1% by mass of sodium silicate at a solution temperature of 20° C. Note that the lubricant b ("AQUACER 497" available from BYK Corporation) is an aqueous emulsion including a paraffin wax as a base.

The five bolts thus prepared, which had been subjected to the base treatment and the immersion treatment (aqueous solution containing 1% by mass of sodium silicate and 3% by mass of the lubricant b; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.111.

The five bolts thus prepared, which had been subjected to the base treatment and the immersion treatment (aqueous solution containing 1% by mass of sodium silicate and 3% by mass of the lubricant b; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 63

As an immersion treatment agent, sodium silicate and a lubricant, "AQUACER 497" (product name) available from BYK Corporation (the lubricant b) were dissolved and mixed in deionized water so as to include 1% by mass of sodium silicate and 5% by mass of the lubricant b to prepare 1000 ml of an aqueous solution containing 1% by mass of sodium silicate and 5% by mass of the lubricant b. Five bolts having been subjected to the base treatment and the immersion treatment were prepared in the same manner as in Example 59, except that the immersion treatment was performed using the 1000 ml of the aqueous solution containing 1% by mass of sodium silicate and 5% by mass of the lubricant b at a solution temperature of 20° C. in place of the 1000 ml of the aqueous solution containing 1% by mass of sodium silicate at a solution temperature of 20° C.

The five bolts thus prepared, which had been subjected to the base treatment and the immersion treatment (aqueous solution containing 1% by mass of sodium silicate and 5% by mass of the lubricant b; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.098.

The five bolts thus prepared, which had been subjected to the base treatment and the immersion treatment (aqueous solution containing 1% by mass of sodium silicate and 5% by mass of the lubricant b; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 64

As an immersion treatment agent, sodium silicate and a lubricant, "AQUACER 1547" (product name) available from BYK Corporation (hereinafter, referred to as "lubricant c") were dissolved and mixed in deionized water so as to include 1% by mass of sodium silicate and 3% by mass of the lubricant c to prepare 1000 ml of an aqueous solution containing 1% by mass of sodium silicate and 3% by mass of the lubricant c. Five bolts having been subjected to the base treatment and the immersion treatment were prepared in the same manner as in Example 59, except that the immersion treatment was performed using the 1000 ml of the aqueous solution containing 1% by mass of sodium silicate and 3% by mass of the lubricant c at a solution temperature of 20° C. in place of the 1000 ml of the aqueous solution containing 1% by mass of sodium silicate at a solution temperature of 20° C. Note that the lubricant c ("AQUACER 1547 available from BYK Corporation) is an aqueous emulsion including a modified polyethylene wax as a base.

The five bolts thus prepared, which had been subjected to the base treatment and the immersion treatment (aqueous solution containing 1% by mass of sodium silicate and 3% by mass of the lubricant c; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.120.

The five bolts thus prepared, which had been subjected to the base treatment and the immersion treatment (aqueous solution containing 1% by mass of sodium silicate and 3% by mass of the lubricant c; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 65

As an immersion treatment agent, sodium silicate and a lubricant, "AQUACER 1547" (product name) available from BYK Corporation (the lubricant c) were dissolved and mixed in deionized water so as to include 1% by mass of sodium silicate and 5% by mass of the lubricant c to prepare 1000 ml of an aqueous solution containing 1% by mass of sodium silicate and 5% by mass of the lubricant c. Five bolts having been subjected to the base treatment and the immersion treatment were prepared in the same manner as in Example 59, except that the immersion treatment was performed using the 1000 ml of the aqueous solution containing 1% by mass of sodium silicate and 5% by mass of the lubricant c at a solution temperature of 20° C. in place of the 1000 ml of the aqueous solution containing 1% by mass of sodium silicate at a solution temperature of 20° C.

The five bolts thus prepared, which had been subjected to the base treatment and the immersion treatment (aqueous solution containing 1% by mass of sodium silicate and 5% by mass of the lubricant c; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.105.

The five bolts thus prepared, which had been subjected to the base treatment and the immersion treatment (aqueous solution containing 1% by mass of sodium silicate and 5% by mass of the lubricant c; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 66

As an immersion treatment agent, sodium silicate and a lubricant, "LUBRON LDW-410" (product name) available from DAIKIN INDUSTRIES, LTD. (hereinafter, referred to as "lubricant d") were dissolved and mixed in deionized water so as to include 1% by mass of sodium silicate and 3% by mass of the lubricant d to prepare 1000 ml of an aqueous solution containing 1% by mass of sodium silicate and 3% by mass of the lubricant d. Five bolts having been subjected to the base treatment and the immersion treatment were prepared in the same manner as in Example 59, except that the immersion treatment was performed using the 1000 ml of the aqueous solution containing 1% by mass of sodium silicate and 3% by mass of the lubricant d at a solution temperature of 20° C. in place of the 1000 ml of the aqueous solution containing 1% by mass of sodium silicate at a solution temperature of 20° C. Note that the lubricant d ("LUBRON LDW-410" available from DAIKIN INDUSTRIES, LTD.) is a dispersion liquid in which fine particles of low molecular weight fluororesin are dispersed in water.

The five bolts thus prepared, which had been subjected to the base treatment and the immersion treatment (aqueous solution containing 1% by mass of sodium silicate and 3% by mass of the lubricant d; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.166.

The five bolts thus prepared, which had been subjected to the base treatment and the immersion treatment (aqueous solution containing 1% by mass of sodium silicate and 3% by mass of the lubricant d; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 67

As an immersion treatment agent, sodium silicate and a lubricant, "LUBRON LDW-410" (product name) available from DAIKIN INDUSTRIES, LTD. (the lubricant d) were dissolved and mixed in deionized water so as to include 1% by mass of sodium silicate and 5% by mass of the lubricant d to prepare 1000 ml of an aqueous solution containing 1% by mass of sodium silicate and 5% by mass of the lubricant d. Five bolts having been subjected to the base treatment and the immersion treatment were prepared in the same manner as in Example 59, except that the immersion treatment was performed using the 1000 ml of the aqueous solution containing 1% by mass of sodium silicate and 5% by mass of the lubricant d at a solution temperature of 20° C. in place of the 1000 ml of the aqueous solution containing 1% by mass of sodium silicate at a solution temperature of 20° C.

The five bolts thus prepared, which had been subjected to the base treatment and the immersion treatment (aqueous solution containing 1% by mass of sodium silicate and 5% by mass of the lubricant d; the surface temperature of the bolts: 185° C. to 220° C.), were then subjected to a measurement of the friction coefficient of the surface in accordance with ISO16047 HH method to calculate the average value of the friction coefficient in the same manner as in Example 59. The average friction coefficient was 0.173.

The five bolts thus prepared, which had been subjected to the base treatment and the immersion treatment (aqueous solution containing 1% by mass of sodium silicate and 5% by mass of the lubricant d; the surface temperature of the bolts: 185° C. to 220° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1008 hours from the start of the salt spray test.

Example 68

As an immersion treatment agent, sodium silicate and a lubricant, "AQUACER 593" (product name) available from BYK Corporation (the lubricant a) were dissolved and mixed in deionized water so as to include 1% by mass of sodium silicate and 3% by mass of the lubricant a to prepare 1000 ml of an aqueous solution containing 1% by mass of sodium silicate and 3% by mass of the lubricant a. Five bolts having been subjected to the base treatment and the immersion treatment were prepared in the same manner as in Example 59, except that the immersion treatment was performed: using the 1000 ml of the aqueous solution containing 1% by mass of sodium silicate and 3% by mass of the lubricant a at a solution temperature of 20° C. in place of the 1000 ml of the aqueous solution containing 1% by mass of sodium silicate at a solution temperature of 20° C.; and with the surface temperature of the bolts of 235° C. to 270° C.

The five bolts thus prepared, which had been subjected to the base treatment and the immersion treatment (aqueous solution containing 1% by mass of sodium silicate and 3% by mass of the lubricant a; the surface temperature of the bolts: 235° C. to 270° C.), were then subjected to a measurement of the friction coefficient of the surface in accordance with ISO16047 HH method to calculate the average value of the friction coefficient in the same manner as in Example 59. The average friction coefficient was 0.162.

The five bolts thus prepared, which had been subjected to the base treatment and the immersion treatment (aqueous solution containing 1% by mass of sodium silicate and 3% by mass of the lubricant a; the surface temperature of the bolts: 235° C. to 270° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 1176 hours from the start of the salt spray test.

Example 69

As an immersion treatment agent, sodium silicate and a lubricant, "AQUACER 593" (product name) available from BYK Corporation (the lubricant a) were dissolved and mixed in deionized water so as to include 1% by mass of sodium silicate and 3% by mass of the lubricant a to prepare 1000 ml of an aqueous solution containing 1% by mass of sodium silicate and 3% by mass of the lubricant a. Five bolts having been subjected to the base treatment and the immersion treatment were prepared in the same manner as in Example 59, except that the immersion treatment was performed: using the 1000 ml of the aqueous solution containing 1% by mass of sodium silicate and 3% by mass of the lubricant a at a solution temperature of 20° C. in place of the 1000 ml of the aqueous solution containing 1% by mass of sodium silicate at a solution temperature of 20° C.; and with the surface temperature of the bolts of 85° C. to 120° C.

The five bolts thus prepared, which had been subjected to the base treatment and the immersion treatment (aqueous solution containing 1% by mass of sodium silicate and 3% by mass of the lubricant a; the surface temperature of the bolts: 85° C. to 120° C.), were then subjected to a measurement of the friction coefficient of the surface in accordance with ISO16047 HH method to calculate the average value of the friction coefficient in the same manner as in Example 59. The average friction coefficient was 0.166.

The five bolts thus prepared, which had been subjected to the base treatment and the immersion treatment (aqueous solution containing 1% by mass of sodium silicate and 3% by mass of the lubricant a; the surface temperature of the bolts: 85° C. to 120° C.), were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 672 hours from the start of the salt spray test.

Comparative Example 15

Five bolts having been subjected only to the base treatment were prepared in the same manner as in Example 59, except that after the base treatment, the immersion treatment with the aqueous solution containing 1% by mass of sodium silicate was not performed and the bolts were cooled to room temperature as they were.

The five bolts thus prepared, which had been subjected only to the base treatment, were then subjected to a measurement of the friction coefficient of the surface in accordance with ISO16047 HH method to calculate the average value of the friction coefficient in the same manner as in Example 59. The average friction coefficient was 0.228.

The five bolts thus prepared, which had been subjected only to the base treatment, were then subjected to a salt spray test in accordance with JIS Z-2371, and it was confirmed whether the bolts had rusted every 168 hours from the start of the test to evaluate the corrosion resistance, in the same manner as in Example 59. As a result, the formation of rust was not confirmed for all five bolts at 168 hours from the start of the salt spray test, but the formation of rust was confirmed on two or more bolts at 336 hours from the start of the test.

INDUSTRIAL APPLICABILITY

According to the present disclosure, it is possible to easily impart better rust proof performance to a metal material or an alloy material. Further, according to the present disclosure, it is possible to provide an article having rust proof performance better than that of the related art.

The invention claimed is:

1. A rustproofing method, comprising:

a step of treating an object to be treated, which contains at least one selected from iron and iron alloys, and having an antirust film containing metal particles of zinc or aluminum or alloy particles of a zinc alloy or an aluminum alloy on a surface thereof, and has been heated to a temperature above 180° C., with an aqueous solution containing an inorganic acid or an inorganic salt, wherein the aqueous solution containing an inorganic acid or an inorganic salt is an aqueous solution containing at least one selected from silicic acid, silicate, and molybdenum acid, and wherein when the aqueous solution contains the silicate, the silicate is limited only to a silicate selected from the group consisting of a lithium salt, a sodium salt, a potassium salt, a magnesium salt, and a calcium salt.

2. The rustproofing method according to claim 1, wherein the object to be treated has a temperature above 220° C. when treated with the aqueous solution.

3. The rustproofing method according to claim 1, wherein the aqueous solution contains 0.1% by mass or more of an inorganic acid and/or an inorganic salt.

4. The rustproofing method according to claim 1, wherein the aqueous solution containing an inorganic acid or an inorganic salt further contains a lubricant.

5. The rustproofing method according to claim 1, wherein the aqueous solution containing an inorganic acid or an inorganic salt has a pH of 4 or more.

6. The rustproofing method according to claim 1, not comprising:

a step of heating the object to be treated to a temperature of 200° C. or more after treating the object to be treated with the aqueous solution.

7. A rustproofing method, comprising: a step of treating an object to be treated, which contains a at least one selected from iron and iron alloys, and having an antirust film containing metal particles of zinc or aluminum or alloy particles of a zinc alloy or an aluminum alloy on a surface thereof, with an aqueous solution containing at least one selected from silicic acid, and silicate, wherein when the aqueous solution contains the silicate, the silicate is limited only to a silicate selected from the group consisting of a lithium salt, a sodium salt, a potassium salt, a magnesium salt, and a calcium salt.

8. The rustproofing method according to claim 7, wherein the aqueous solution further contains a lubricant.

9. The rustproofing method according to claim 7, not comprising: a step of heating the object to be treated to a temperature of 200° C. or more after treating the object to be treated with the aqueous solution.

* * * * *